United States Patent [19]

Hiroshi et al.

[11] 4,318,417

[45] Mar. 9, 1982

[54] FLAVORANT COMPOSITION FOR TOBACCO, METHOD FOR PRODUCING THE SAME TOBACCO PRODUCT COMPRISING SAID COMPOSITION

[75] Inventors: Matsushita Hiroshi; Shinozaki Matsue, both of Yokohama, Japan

[73] Assignee: The Japan Tobacco & Salt Public Corporation, Japan

[21] Appl. No.: 113,747

[22] Filed: Jan. 21, 1980

[30] Foreign Application Priority Data

Jan. 30, 1979 [JP] Japan ..... 54/8793

[51] Int. Cl.[3] ..... A24B 3/12

[52] U.S. Cl. ..... 131/274; 131/334

[58] Field of Search ..... 131/261 A, 17 R, 144, 131/274–279, 334

[56] References Cited

U.S. PATENT DOCUMENTS 1,972,718 9/1934 Sharlit ..... 131/17 R

*Primary Examiner*—Vincent Millin

*Attorney, Agent, or Firm*—McGlew and Tuttle

[57] ABSTRACT

Flavorant composition for tobacco may be produced by heating certain synthesized inorganic ion-exchangeable compound containing zirconium or titanium metal together with tobacco flavorant in organic solvent to adsorb the flavorant to the exchanger. This flavorant composition may be applied advantageously to filter cigarette so as to be added to the portion of filter tip in the form of triple-filter or dual-filter. The flavorant in the flavorant composition having been added to filter tip scarcely volatilizes when it has only been left as it is, however such flavorant may be released readily from the composition by wet smoke passing through the filter tip when smoked, whereby aroma and taste of the flavorant may effectively be produced. The amount of tobacco flavorant capable of producing moderate aroma and taste is far lesser than that of flavorant that has customarily been added to the portion of blended cut tobacco. The ion-exchanger usable in the invention doesn't affect the essential aroma and taste of tobacco flavorants.

23 Claims, No Drawings

FLAVORANT COMPOSITION FOR TOBACCO, METHOD FOR PRODUCING THE SAME TOBACCO PRODUCT COMPRISING SAID COMPOSITION

FIELD OF THE INVENTION

The present invention relates to flavorant composition for tobacco, and to method for producing the same, and further to tobacco product comprising said flavorant composition.

PRIOR ARTS

Various kinds of flavorants have hitherto been employed for the manufacture of tobacco product. However, many of the flavorants are volatile so that there has been disadvantage in that such flavorants volatilize somewhat in the course of or after manufacturing steps of tobacco. In order to remove the above disadvantage, several processes have hitherto been proposed wherein the flavorants have been mixed with other materials to make so-called flavorant compositions. For example, there have been known such processes as flavorant adsorbed to porous particles is dispersed in gas-passable plastics. Flavorant is spray-dried together with water soluble high polymer to coat by the polymer, followed by further spray-drying of the emulsion prepared by dispersing the coated flavorant in oil. In another method flavorant is locked by polysaccharide or the like (cf. Japanese pat. publn. Nos. 6,283/68, 12,600/70 and 23,963/68). Flavorant is wrapped in microcapsules made of certain organic compounds in another method (cf. Japanese pat. OS Nos. 79/73 and 63,970/76). However, the above conventional flavorant compositions have disadvantages also in that the desired volatile flavorants have not necessarily been able to be fixed in said compositions sufficiently, and further in that some of these compositions are subjected to restriction of industrial use for tobacco in view of undesirable chemical properties of the adsorbents, coating agents or locking agents having been employed therein.

The characteristics to be provided of the adsorbents for tobacco flavorants reside in that they have not only excellent fixing-ability of flavorants but also effective releasing-ability of such adsorbed flavorants when the tobacco products to which said adsorbents (i.e., flavorant compositions) have been used are smoked, and further that the adsorbents themselves are stable chemically and thermally, thus resulting in that they do not affect the essential aroma and taste of the flavorants.

We studied the adsorbents of volatile flavorants provided with the above characteristics and found that certain of the so-called synthesized inorganic ion-exchangeable compounds which have recently been studied and developed had said characteristics. That is, such inorganic ion-exchangers are known to have generally the properties of heat-resistance, radioactive-resistance, selective adsorption and the stability for oxidizing agents and organic solvents, whereby these exchangers have been applied to the analytical detection or removal of components of a very small quantity contained in a mixture of several inorganic components, and further been utilized industrially for the production of paints, adhesive agents and waterproofing agents. On the other hand, active alumina, silicagel, etc., which come structurally within the category of said inorganic ion-exchangers and which have long been known have abilities of adsorbing not only inorganic ions but also many kinds of organic compounds, such as, acetate of saccharides, steroids, carotinoid, vitamin A, indigonoid and chlorophyll, whereby said inorganic compounds have hitherto been used for the detection of said organic compounds in the liquid- and gas-chromatographies.

In view of the adsorbability for many organic compounds as well as the heat-resistance and stability for oxidizing agents and organic solvents of the synthesized inorganic ion-exchangers as mentioned in the above, we studied the adsorption and release of tobacco flavorants on or from such ion-exchangers extensively, and found that certain inorganic ion-exchangers containing zirconium or titanium metal had excellent adsorbability for nonvolatile flavorants as well as volatile ones and releasing-ability therefrom, and that these ion-exchangers did not affect the essential aroma and taste of tobacco flavorants.

SUMMARY OF THE INVENTION

The present invention resides in flavorant composition for tobacco comprising synthesized inorganic ion-exchanger which is one member selected from the group consisting of zirconium phosphate, zirconium polyphosphate, zirconium heteropolyphosphate, hydrous zirconium oxide and hydrous titanium oxide and to which tobacco flavorant has been adsorbed; method for producing said flavorant composition by heating said inorganic ion-exchanger together with tobacco flavorant in organic solvent so as to adsorbe the flavorant to the exchanger; and, tobacco product comprising said flavorant composition.

According to the present invention, tobacco flavorant is adsorbed steadily to the adsorbent of inorganic ion-exchanger, while said flavorant is released from said composition readily when the tobacco product applying the composition thereto has been smoked. The adsorbent for use in the invention is stable and doesn't affect the essential aroma and taste of the tobacco flavorant used. The tobacco product, e.g., filter cigarette according to the invention may produce the aroma and taste of the flavorant used effectively when smoked.

DETAILED EXPLANATION OF THE INVENTION

According to the present invention, the following zirconium or titanium compounds are employed as adsorbents of tobacco flavorants:

zirconium phosphate zirconium polyphosphates, for example, zirconium salts of pyrophosphoric acid, trimetaphosphoric acid, hexametaphosphoric acid and tripolyphosphoric acid zirconium salts of heteropoly-acids, for example, zirconium phosphate silicate, zirconium phosphate molybdate and zirconium phosphate tungstate hydrous zirconium oxide hydrous titanium oxide.

The above adsorbent compounds are all known as inorganic ion-exchangers having hitherto been chemically synthesized [cf. Bulletin of the Society of Sea Water Science, Japan, 23, 102(1969), ibid., 24, 96(1970), ibid., 25, 397(1972); The Bulletin of the Japan Society for Analytical Chemistry, 23, 1254(1974)]. Indicating a method for preparing each of the above compounds, first, phosphoric acid or aqueous solution of alkali salt of polyphosphoric acid is added to the aqueous solution of zirconium chloride or oxychloride to which hydrochloric acid has been added, while stirring, and the precipitates of zirconium phosphate or polyphosphate formed are filtered and washed with water to remove $Cl^-$ therefrom. The precipitates are dried and put into a water again to be broken to 16–80 meshes size to prepare the desired compound particles. Zirconium salts of heteropoly-acids may be prepared in the same manners as above except using phosphoric acid together with sodium silicate, sodium tungstate or ammonium molybdate in place of phosphoric acid or alkali salt of polyphosphoric acid.

The above zirconium compounds for use in the present invention are amorphous or crystalline particles with transparent, gray, green or white color, the diameters of which are 1.0–0.1 mm (corresponding to 16–150 meshes), their specific gravities being about 1–2.5. The structures of these compounds have hitherto been presumed to be such a one as the so-called coordination compounds in which phosphoric acid-, polyphosphoric acid- or heteropoly-acid-radical is coordinated around the nucleus of ZrO are combined (or polymerized) in the form of layer or chain or network. The molar ratio of zirconium to phosphoric acid (Zr:P) of these adsorbent compounds depends on the ratio of the raw materials having been used for their preparation. In the present invention, it is desirable to employ the zirconium compounds having the molar ratio (Zr:P) of 1:1–3. While, the molar ratio of zirconium to silicic acid, molybdic acid or tungstic acid (Zr:Si,Zr:Mo,Zr:W) in the above is suitable to be 1:0.5–3.0.

On the other hand, hydrous zirconium oxide and hydrous titanium oxide may be prepared by such a manner as equimol of aqueous solution of alkali hydroxide is added to the aqueous solution of zirconium or titanium chloride or oxychloride and the hydrous oxides of these metals precipitated are separated therefrom, aged and dried to form amorphous or crystalline particles. These hydrous oxide compounds also present almost the similar external appearance to that of the above zirconium compounds containing phosphoric acid, and their structures have hitherto been presumed to be polymers of the coordination compounds represented by $ZrO(OH)_2.xH_2O$ and $TiO(OH)_2.xH_2O$, respectively.

The adsorbent compounds for use in the present invention scarcely dissolve in water and organic solvents, and even when heated at the temperature of 800° C., they are only converted into zirconium polyphosphate or zirconium- or titanium-oxide each of which is stable and harmless.

According to the method of the present invention, the adsorbent compound is admixed in the solution prepared by dissolving tobacco flavorant in suitable organic solvent and the mixture is heated, under reflux if necessary, whereby the adsorption of flavorant to the adsorbent compound may effectively be accomplished. Suitable heating temperature and period of time as well as the concentration of flavorant in the solution are regulated according to the kinds of flavorants and adsorbents to be used. In general, heating periods of 10–120 minutes and 0.2–20% by weight of flavorant based on the weight of organic solvent used are advantageously employed. As the organic solvents in the above, ethyl alcohol, benzene, ether, acetone, chloroform, hexane, ethylacetate, and the like, are used suitably. The adsorbent compound having been heated with the tobacco flavorant in the organic solvent is then dried under reduced pressure at the temperature below 90° C., desirably below 60° C. to remove the organic solvent therefrom, whereby the flavorant composition consisting of the adsorbent and tobacco flavorant may be prepared.

The tobacco flavorants usable in the present invention include nonvolatile flavorants as well as volatile flavorants both kinds of which have hitherto been used for the manufacture of tobacco, said volatile flavorants being e.g., ethylacetate, isoamylacetate, propylisobutyrate, isobutylbutyrate, ethylbutyrate, ethylvalerate, benzylformate, menthol, limonene, cymene, pinene, linalool, geraniol, citronellol, citral, peppermint oil, orange oil, coriander oil, lemon oil and borneol, while said nonvolatile flavorants being e.g., tobacco extract, coccoa extract, licorice extract and fruit extract. Mixture of volatile flavorants and nonvolatile flavorants may also be employed in the invention.

The flavorant composition of the invention prepared as above is applied to tobacco products, particularly to filter cigarette. When applied to filter cigarette, the flavorant composition is advantageously added to the portion of filter tip, opposing to flavorants or known flavorant compositions for tobacco having hitherto been almost added to the portion of cigarette (i.e., blended cut tobacco). For example, the flavorant composition of the invention is filled between two short acetate filter tips to form the so-called triple-filter, or the composition is dispersed among the thin fibres of the inner acetate filter tip which is then incorporated with the outer normal acetate filter tip to form the so-called dual-filter, said forms having hitherto been employed generally for addition of charcoal particles to filter tip. The flavorant composition of the invention may also be used by inserting them in cigarette holder through which cigarette will be smoked. The amount of the flavorant composition to be added to filter tip is generally 1–100 mg, desirably 5–80 mg per cigarette. The flavorant in the flavorant composition of the present invention which has been added to filter tip of cigarette scarcely volatilizes, when the cigarette has only been left as it is, but retains for relatively long period of time therein, however, such flavorant is released readily from the composition by wet (i.e., moisture containing) smoke passing through the filter tip when the cigarette has been smoked, whereby aroma and taste of the flavorant may effectively be produced. According to the invention, the amount of tobacco flavorant capable of producing proper (or moderate) aroma and taste is far lesser than that of flavorant that has customarily been added to the portion of blended cut tobacco. When the cigarette according to the invention is smoked, conversion of essential aroma and taste of the flavorant does not occur.

The adsorbent compounds for use in the present invention have orally a little toxicity [cf. Extract Report on Toxicity of One Thousand Main Chemicals, published by The International Technical Information Institute, Japan, pages 343 and 375]. Further, the filter cigarette of the present invention is almost equal to the general (common) filter cigarette in respect of the amounts of constituents which have been contained in the so-called tobacco main stream smoke and which have hitherto been regarded as being harmful to health, when such filter cigarettes smoked. Table I demonstrates the respective amounts of constituents in the tobacco main stream smoke per cigarette generated from the filter cigarette of the invention and from the control filter cigarette, said cigarette of the invention having been prepared by attaching the acetate filter tip comprising the flavorant composition, which filter tip has been prepared in the same manner as in Example 2 described later but using zirconium phosphate as adsorbent, to a cigarette rod made of blended cut tobacco of bright yellow, while said control filter cigarette having consisted of a normal acetate filter tip and a cigarette rod made of the same blended cut tobacco of bright yellow as above in which however the same flavorant as in Example 2 has been sprinkled, further said main stream smoke having been produced by smoking the cigarettes periodically for 2 seconds every minute (35 ml a puff) to the butt length of 30 mm. The results of the table suggest that the adsorbent as well as flavorant in the filter cigarette of the invention will not be decomposed chemically when smoked.

TABLE I

| | Tar (mg) | Cyanide (as HCN) (μg) | Carbon monoxide (mg) | Nitrogen oxide (μg) | Hydrogen sulfide (μg) | Ammonia (μg) | Benzo(a)pyren (ng) |
|---|---|---|---|---|---|---|---|
| Control cigarette | 20 | 81 | 10 | 82 | 96 | 30 | 21 |
| Cigarette of the invention | 21 | 72 | 11 | 70 | 75 | 27 | 22 |

EMBODIMENTS OF THE INVENTION

The details of the invention will be illustrated by the following examples, however the descriptions in these examples are not to be considered as limitations, since many changes in the details may be made without departing from the spirit of the invention.

EXAMPLE 1

The various kinds of adsorbent compounds for use in the invention are prepared by the following manners:

(1) Zirconium phosphate

Three hundred and twenty-two (322) g of zirconium oxychloride ($ZrOCl_2.8H_2O$) is dissolved in 4 liter of water, and to this solution is added 200 g of concentrated hydrochloric acid. To the resulting acidic solution is added further aqueous solution consisting of 250 g of 98% phosphoric acid and 5 liter of water, and, after stirred for about 20 minutes, the solution is left overnight. Precipitates of zirconium phosphate formed in the solution are centrifuged, washed with water sufficiently and dried at about 80° C. The solid matter obtained is put again in a water to be broken, and the resulting precipitates in the water are centrifuged, dried and sieved to prepare the desired compound particles of 24–32 meshes.

(2) Zirconium tripolyphosphate

The same manner as in the above (1) except using 371 g of sodium tripolyphosphate ($Na_5P_3O_{10}$) in place of 250 g of 98% phosphoric acid is conducted, whereby particles of the desired compound are prepared.

(3) Zirconium hexametaphosphate

The same manner as in the above (1) except using 600 g of sodium hexametaphosphate [$(NaPO_3)_6$] in place of 250 g of 98% phosphoric acid is conducted, whereby particles of the desired compound are prepared.

(4) Zirconium pyrophosphate

By conducting the same manner as in the above (1) except using 448 g of sodium pyrophosphate ($Na_4P_2O_7.10H_2O$) in place of 250 g of 98% phosphoric acid, particles of the desired compound are prepared.

(5) Zirconium trimetaphosphate

The same manner as in the above (1) except using 312 g of sodium trimetaphosphate [$(NaPO_4)_3$], which has been prepared by heating sodium phosphate ($NaH_2PO_4.2H_2O$) at about 500° C. for 3 hours, in place of 250 g of 98% phosphoric acid is conducted, whereby particles of the desired compound are prepared.

(6) Zirconium phosphate silicate

Three hundred and twenty-two (322) g of zirconium oxychloride is dissolved in 3 liter of water, and to this solution is added 200 g of concentrated hydrochloric acid. To the resulting acidic solution are added the aqueous solution prepared by dissolving 552 g of sodium silicate ($Na_2SiO_3$) in 10 liter of water as well as the aqueous solution consisting of 100 g of 98% phosphoric acid and 3 liter of water, and, after stirred for about 30 minutes, precipitates of zirconium phosphate silicate formed in the solution are separated. The subsequent procedures are conducted in the same manner as in the above (1) to prepare particles of the desired compound.

(7) Zirconium phosphate tungstate

The same manner as in the above (6) except using 330 g of sodium tungstate ($Na_2WO_4.2H_2O$) in place of 552 g of sodium silicate is conducted to prepare particles of the desired compound.

(8) Zirconium phosphate molybdate

The same manner as in the above (6) except using 600 g of ammonium molybdate [$(NH_4)_6Mo_7O_{24}.4H_2O$] in place of 552 g of sodium silicate is conducted to prepare particles of the desired compound.

(9) Hydrous titanium oxide

One hundred and ninety (190) g of titanium tetrachloride ($TiCl_4$) is dissolved in 15 liter of water, and PH of the solution is adjusted to 7 by adding aqueous solution of sodium hydroxide dropwise. The precipitates formed are filtered and dried to prepare amorphous particles of the desired compound.

(10) Hydrous zirconium oxide

The same manner as in the above (9) except using 322 g of zirconium oxychloride in place of 190 g of titanium tetrachloride is conducted, whereby amorphous particles of the desired compound are prepared.

Decimal five (0.5) g each of the adsorbent compounds prepared in the above is mixed in a solution which has been prepared by dissolving 0.1 g of ethylvalerate in 30 ml of ethyl alcohol, and the mixture is heated under reflux for 60 minutes. The adsorbent in the mixture is dried at 40° C. under reduced pressure, whereby particles of the respective flavorant compositions in each of which ethylvalerate is absorbed are prepared. The same manner as the above except using 1-menthol in place of ethylvalerate is conducted, whereby particles of the respective flavorant compositions in each of which 1-menthol is adsorbed are prepared.

These flavorant compositions are left under the conditions of temperature of 20° C. and relative humidity of 60%, and the amounts of flavorants remaining in the flavorant compositions are estimated respectively at predetermined intervals by gas-chromatography using SHIMAZU GC-4 CM Type apparatus [with the filler of BGA 10%/chromsorb AW(60–80 meshes); carrier gas ($N_2$) of 60 ml/min]. Percentages of the amounts of remaining flavorants to those of the flavorants initially used are shown in Table II. On the other hand, the same flavorants as the above are penetrated only in filter papers (Toyo Roshi No. 3) respectively, which are then left and tested in the same manner as above, the data of which are annexed to Table II as control test. From the table, it is seen that the flavorants in the flavorant compositions of the invention are, by only being left of them, released generally which relatively little rate, while the flavorants in control are released rapidly.

TABLE II

| Adsorbents | Ethylvalerate remained (%) Leaving day(s) 1 | 3 | 5 | 7 | 10 | 20 | 1-Menthol remained (%) Leaving day(s) 1 | 3 | 5 | 7 | 10 | 20 |
|---|---|---|---|---|---|---|---|---|---|---|---|---|
| Zirconium phosphate | 83 | 68 | 63 | 60 | 57 | 38 | 85 | 73 | 67 | 65 | 65 | 60 |
| Zirconium tripolyphosphate | 80 | 70 | 65 | 62 | 58 | 35 | 79 | 72 | 65 | 62 | 60 | 58 |
| Zirconium hexametaphosphate | 78 | 70 | 60 | 58 | 52 | 30 | 75 | 68 | 62 | 58 | 52 | 45 |
| Zirconium pyrophosphate | 74 | 65 | 58 | 51 | 48 | 31 | 72 | 63 | 59 | 57 | 48 | 40 |
| Zirconium trimetaphosphate | 78 | 70 | 58 | 52 | 48 | 30 | 75 | 65 | 60 | 58 | 52 | 42 |
| Zirconium phosphate silicate | 90 | 85 | 80 | 77 | 69 | 57 | 88 | 85 | 83 | 80 | 76 | 71 |
| Zirconium phosphate tungstate | 88 | 82 | 78 | 71 | 64 | 55 | 81 | 76 | 74 | 71 | 67 | 60 |
| Zirconium phosphate molybdate | 60 | 45 | 40 | 35 | 25 | 17 | 65 | 53 | 42 | 34 | 30 | 25 |
| Titanium hydrous oxide | 58 | 45 | 45 | 40 | 30 | 20 | 70 | 45 | 40 | 32 | 30 | 28 |
| Zirconium hydrous oxide | 62 | 50 | 45 | 40 | 35 | 28 | 83 | 78 | 70 | 65 | 60 | 52 |
| Filter paper (control) | 5 | | | | | | | 58 | 30 | 12 | | |

EXAMPLE 2

Decimal five (0.5) g each of zirconium phosphate, zirconium hexametaphosphate, zirconium phosphate silicate and hydrous titanium oxide which have been prepared in Example 1 is mixed in a solution prepared by dissolving 0.125 g of orange oil in 30 ml of alcohol, and the mixture is heated under reflux for 30 minutes. The adsorbent compound in the mixture is dried at 40° C. under reduced pressure, whereby the respective flavorant compositions in each of which orange oil has been adsorbed are prepared.

Ten (10) mg each of the flavorant compositions in the above is dispersed among the fibres of an inner acetate filter tip which is then incorporated with an outer normal acetate filter tip to form the dual-filter, and this dual-filter is attached to a cigarette rod made of the same blended cut tobacco as has hitherto been used for "hi-lite" (trademark; mfd. by The Japan Tobacco & Salt Public Corp.), whereby the filter cigarettes of the invention are prepared. On the other hand, control filter cigarette is prepared by using a normal acetate filter tip and a cigarette rod made of the same blended cut tobacco as above in which however orange oil has been sprinkled in routine manner so as the amount thereof per one cigarette to be equal to that of orange oil per one cigarette of the invention prepared in the above.

The cigarettes of the invention and control cigarette are left in the atmosphere of temperature of 20° C. and relative humidity of 60% for sixty days, and then subjected to sensory test. The procedures of the test are carried out as follows: the aroma, taste, and the like, which have been brought when the cigarettes are smoked, are evaluated, by a panel consisting of twenty persons, applying the so-called pair test method. The results of test are shown in Table III, the numbers in which represent those of persons who have praised cigarette of the present invention.

TABLE III

| | Zirconium phosphate | Zirconium hexameta-phosphate | Zirconium phosphate silicate | Hydrous titanium oxide |
|---|---|---|---|---|
| aroma | 16 | 18 | 18 | 16 |
| taste | 16 | 19 | 19 | 15 |
| offensive odor | 14 | 15 | 15 | 14 |
| offensive taste | 14 | 16 | 15 | 15 |
| irritation | 12 | 13 | 13 | 12 |
| bad after tasting | 14 | 15 | 15 | 14 |

From the table, the cigarettes of the present invention are found to be superior to the control cigarette, especially in aroma and taste. Besides, it has seen that the so-called room-aroma brought when the cigarettes of the invention had been smoked was markedly intense, such phenomenon having been not found for the control cigarette.

EXAMPLE 3

Three kinds of filter cigarettes of the present invention are prepared in the following manner in which the same blended flavorant, blended cut tobacco and filter tip as those having hitherto been used for the manufacture of "Seven Stars" (trademark; mfd. by The Japan Tobacco & Salt Public Corp.) are employed, said blended flavorant having however been used for "Seven Stars" so as to add its alcohol solution to the blended cut tobacco in the conventional manner, while said filter tip having consisted of the so-called inner charcoal filter tip, which has been made by dispersing charcoal particles among the fibres of a normal acetate filter tip, and outer normal acetate filter tip without charcoal particles: 0.5 g each of hydrous zirconium oxide which has been prepared in Example 1 as mixed in the solutions prepared by dissolving respectively 0.6 g, 0.3 g and 0.2 g of the blended flavorant in 30 ml each of ethyl alcohol, and the resulting mixture is heated under reflux for 60 minutes. The adsorbent compound in the mixture is dried at 40° C. under reduced pressure to remove ethyl alcohol therefrom, whereby are prepared the flavorant compositions in which 0.6 g, 0.3 g and 0.2 g of the blended flavorants have respectively been adsorbed.

Five (5) mg each of the above flavorant compositions is filled between said inner charcoal filter tip and outer normal acetate filter tip, to form a triple-filter tip, and this filter tip is attached to cigarette rod made of the blended cut tobacco, whereby are prepared the three kinds of cigarettes using the respective flavorant compositions of 0.6 g, 0.3 g and 0.2 g blended flavorants which refer hereinafter to cigarette I, cigarette II and cigarette III of the invention, respectively, the amount of the blended flavorant per one of said cigarette I of the invention corresponding to that of the blended flavorant per one cigarette of commercial "Seven Stars".

The cigarettes of the invention prepared as above and "Seven Stars" (as control cigarette) are left and tested in the same manner as in Example 2.

The results of test for the cigarettes which have been left for only seven days are as follows: all the persons of panel agreed with each other on that cigarette I of the invention had too rich aroma and taste, and 15 persons agreed also on that cigarette II of the invention had relatively rich aroma and taste while the other 5 persons indicated that the aroma and taste of cigarette II of the invention were moderate. For the cigarette III of the invention, 18 persons agreed on having moderate aroma and taste and being almost equal to control cigarette.

Next, the results of test for the cigarettes having been left for sixty days are as follows: while 17 persons in panel indicated that aroma and taste of control cigarette were decreased somewhat to yield tobacco irritation and astringency, 17 persons commented that aroma and taste of cigarettes I, II and III of the invention were almost the same as those of cigarettes I, II and III left for seven days respectively.

The above results reveal that for the tobacco products of the present invention about a third of the amount of the blended flavorant which has hitherto been added to the blended cut tobacco as in "Seven Stars" serves for yielding corresponding aroma and taste to those of the latter, and that such aroma and taste of cigarette of the invention may also be produced after the cigarette has been left for relatively long period of time.

EXAMPLE 4

By using the same blended flavorant and blended cut tobacco as having hitherto been used for the manufacture of "hi-lite", the filter cigarette of the present invention as well as the three kinds of control filter cigarettes are prepared as follows.

Cigarette of the invention: 0.5 g of zirconium phosphate silicate prepared in Example 1 is mixed in the solution prepared by dissolving 0.125 g of the blended flavorant in 30 ml of ethyl alcohol and the resulting mixture is heated under reflux for 30 minutes. The adsorbent in the mixture is dried at 40° C. under reduced pressure. The subsequent procedures are conducted in the same manner as in Example 2 to prepare the filter cigarette of the invention, with the proviso that the amount of the blended flavorant per one cigarette is made to be the same as that of the blended flavorant having hitherto been used per one cigarette of "hi-lite", the contents of said proviso being applied for control cigarettes I, II and III hereinafter.

Control cigarette I: 125 mg of blended flavorant is injected into acetate filter tip by using needle and the filter tip is attached to a cigarette rod made of the blended cut tobacco.

Control cigarette II: the same procedures are conducted as those in the preparation of the above cigarette of the invention except using charcoal particles of 24–32 meshes in place of zirconium phosphate silicate to prepare the filter cigarette.

Control cigarette III: the same procedures are conducted as those in the preparation of the above cigarette of the invention except using zeolite particles in place of zirconium phosphate silicate to prepare the filter cigarette, said zeolite particles having however been, after the adsorption of the flavorant, granulated so as to be 24–32 meshes.

The cigarette of the invention as well as the control cigarettes I, II and III are left and tested in the same manner as in Example 2. The results of test are as follows.

For control cigarette I: the cigarette having been left for seven days has little aroma and taste, though it has slight aroma of menthol. The cigarette left for sixty days has no aroma but produce irritation, astringency, offensive odor and offensive taste.

For control cigarette II: aroma and taste of the cigarette having been left for seven days as well as those of the cigarette left for sixty days decrease while these cigarettes have charcoal taste, thus resulting in an image of cigarette quite differing to that of "hi-lite".

For control cigarette III: the cigarette left for seven days has a little aroma and taste, but the cigarette left for sixty days lose all aroma and taste while producing bitterness and astringency.

For cigarette of the invention: aroma and taste of the cigarettes left for sixty days as well as seven days are markedly intense so as to remove offensive odor and offensive taste of tobacco, and many of the persons in panel comment that it will be rather better to decrease the amount of the blended flavorant to be used therefor.

EXAMPLE 5

One (1) g of zirconium tripolyphosphate prepared in Example 1 is mixed in the solution prepared by dissolving 0.1 g of alcoholic extract of hydrangea leaves, 0.1 g of tobacco extract, 0.05 g of chocolate flavor, 0.01 g of γ-decalactone and 0.01 g of ethyl valerate in 50 ml of ethyl alcohol, and the resulting mixture is heated under reflux for 40 minutes. The adsorbent compound is dried at 35° C. under reduced pressure to prepare the flavorant composition to which the above many kinds of tobacco flavorant have been adsorbed. 100 mg of the flavorant composition is filled between two short normal acetate filter tips which have been set in a cigarette holder. A cigarette rod having no filter is fitted to the holder and smoked through the filter tip, whereby excellent aroma and taste are produced.

We claim:

1. Flavorant composition for tobacco comprising a synthesized inorganic ion-exchanger which is one member selected from the group consisting of zirconium phosphate, zirconium polyphosphate, zirconium heteropolyphosphate, hydrous zirconium oxide and hydrous titanium oxide and to which tobacco flavorant has been adsorbed.

2. Flavorant composition for tobacco as claimed in claim 1, wherein polyphosphate is one member selected from the group consisting of pyrophosphate, hexametaphosphate and tripolyphosphate.

3. Flavorant composition for tobacco as claimed in claim 1 or 2, wherein heteropolyphosphate is one member selected from the group consisting of phosphate silicate, phosphate molybdate and phosphate tungstate.

4. Method for producing the flavorant composition for tobacco which comprises, (a) admixing a synthesized inorganic ion-exchanger selected from the group consisting of zirconium phosphate, zirconium polyphosphate, zirconium heteropolyphosphate, hydrous zirconium oxide and hydrous titanium oxide in the solution prepared by dissolving tobacco flavorant in organic solvent, (b) heating the mixture resulted from the step (a), and, (c) drying the ion-exchanger to remove the organic solvent therefrom.

5. Method for producing the flavorant composition for tobacco as claimed in claim 4, wherein polyphosphate is one member selected from the group consisting of pyrophosphate, hexametaphosphate and tripolyphosphate.

6. Method for producing the flavorant composition for tobacco as claimed in claim 4 or 5, wherein heteropolyphosphate is one member selected from the group consisting of phosphate silicate, phosphate molybdate and phosphate tungstate.

7. Method for producing the flavorant composition for tobacco as claimed in claim 4 or 5, wherein the heating in step (b) is conducted under reflux of the organic solvent used.

8. Method for producing the flavorant composition for tobacco as claimed in claim 6, wherein the heating in step (b) is conducted under reflux of the organic solvent used.

9. Tobacco product comprising a flavorant composition for tobacco of synthesized inorganic ion-exchanger which is selected from the group consisting of zirconium phosphate, zirconium polyphosphate, zirconium heteropolyphosphate, hydrous zirconium oxide and hydrous titanium oxide and to which tobacco flavorant has been adsorbed.

10. Filter cigarette comprizing a filter tip having added thereto a flavorant composition for tobacco of synthesized inorganic ion-exchanger which is selected from the group consisting of zirconium phosphate, zirconium polyphosphate, zirconium heteropolyphosphate, hydrous zirconium oxide and hydrous titanium oxide and to which tobacco flavorant has been adsorbed.

11. Filter cigarette as claimed in claim 10, wherein polyphosphate is one member selected from the group consisting of pyrophosphate, hexametaphosphate and tripolyphosphate.

12. Filter cigarette as claimed in claim 10 or 11, wherein heteropolyphosphate is one member selected from the group consisting of phosphate silicate, phosphate molybdate and phosphate tungstate.

13. Filter cigarette as claimed in claim 10, wherein the flavorant composition for tobacco is produced by (a) admixing a synthesized inorganic ion-exchanger selected from the group consisting of zirconium phosphate, zirconium polyphosphate, zirconium heteropolyphosphate, hydrous zirconium oxide and hydrous titanium oxide in the solution prepared by dissolving tobacco flavorant in organic solvent, (b) heating the mixture resulted from said step (a), and (c) drying the ion-exchanger to remove the organic solvent therefrom.

14. Filter cigarette as claimed in claim 13, wherein polyphosphate is one member selected from the group consisting of pyrophosphate, hexametaphosphate and tripolyphosphate.

15. Filter cigarette as claimed in claim 13 or 14, wherein heteropolyphosphate is one member selected from the group consisting of phosphate silicate, phosphate molybdate and phosphate tungstate.

16. Filter cigarette as claimed in claim 13 or 14, wherein the heating the step (b) is conducted under reflux of the organic solvent used.

17. Filter cigarette as claimed in claim 15, wherein the heating in step (b) is conducted under reflux of the organic solvent used.

18. Filter cigarette as claimed in claim 10 or 11, wherein the flavorant composition for tobacco is added to the filter tip in the form of triple-filter or dual-filter.

19. Filter cigarette as claimed in claim 12, wherein the flavorant composition for tobacco is added to the filter tip in the form of triple-filter or dual-filter.

20. Filter cigarette as claimed in claim 13 or 14, wherein the flavorant composition for tobacco is added to the filter tip in the form of triple-filter or dual-filter.

21. Filter cigarette as claimed in claim 15, wherein the flavorant composition for tobacco is added to the filter tip in the form of triple-filter or dual-filter.

22. Filter cigarette as claimed in claim 16, wherein the flavorant composition for tobacco is added to the filter tip in the form of triple-filter or dual-filter.

23. Filter cigarette as claimed in claim 17, wherein the flavorant composition for tobacco is added to the filter tip in the form of triple-filter or dual-filter.

* * * * *